US012312958B1

(12) United States Patent
Zeng et al.

(10) Patent No.: US 12,312,958 B1
(45) Date of Patent: May 27, 2025

(54) METHOD OF SEGMENTED GROUTING FOR REPAIRING AQUIFERS IN MINING AREA

(71) Applicant: CHINA UNIVERSITY OF MINING AND TECHNOLOGY, BEIJING, Beijing (CN)

(72) Inventors: Yifan Zeng, Beijing (CN); Weihong Yang, Beijing (CN); Qiang Wu, Beijing (CN); Xinjiang Wei, Beijing (CN); Kai Pang, Beijing (CN); Xuan Xiao, Beijing (CN); Xue Liu, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 18/912,998

(22) Filed: Oct. 11, 2024

(30) Foreign Application Priority Data

Jun. 6, 2024 (CN) ..... 202410733288.7

(51) Int. Cl.
*E21F 15/00* (2006.01)

(52) U.S. Cl.
CPC ..... *E21F 15/00* (2013.01)

(58) Field of Classification Search
CPC ..... E21F 15/00
See application file for complete search history.

(56) References Cited

U.S. PATENT DOCUMENTS

| | | | | |
|---|---|---|---|---|
| 11,459,849 | B1 * | 10/2022 | Zeng | E21B 27/00 |
| 11,781,429 | B1 | 10/2023 | Zeng et al. | |
| 2016/0356138 | A1 * | 12/2016 | Hughes | E21B 43/281 |

FOREIGN PATENT DOCUMENTS

| | | | |
|---|---|---|---|
| AU | 2020103699 | A4 | 2/2021 |
| CN | 103696775 | A | 4/2014 |
| CN | 109915071 | A | 6/2019 |
| CN | 112855214 | A | 5/2021 |
| CN | 115419384 | A | 12/2022 |

(Continued)

OTHER PUBLICATIONS

Second Office Action issued in counterpart Chinese Patent Application No. 202410733288.7, dated Nov. 30, 2024.

(Continued)

*Primary Examiner* — Kyle Armstrong
(74) *Attorney, Agent, or Firm* — Westbridge IP LLC

(57) ABSTRACT

Disclosed is a method of segmented grouting for repairing aquifers in a mining area after mining. The method may include: drilling a grouting hole in a ground area corresponding to a water inflow position in a goaf; and performing a segmented grouting in a target grouting layer through the grouting hole. The segmented grouting may include: a scour and migration grouting, a splitting and diffusion grouting, and a sedimentation and compaction grouting. The scour and migration grouting may use a first slurry with a first specific gravity and a first pump volume for grouting. The splitting and diffusion grouting may use a second slurry with a second specific gravity and a second pump volume for grouting. Moreover, the sedimentation and compaction grouting may use a third slurry with a third specific gravity and a third pump volume for grouting.

7 Claims, 7 Drawing Sheets

(56) References Cited

FOREIGN PATENT DOCUMENTS

| | | | | |
|---|---|---|---|---|
| EP | 0293686 | A1 * | 5/1988 | |
| WO | WO-2015092854 | A1 * | 6/2015 | ..... E02D 3/12 |
| WO | WO-2021103193 | A1 * | 6/2021 | ..... E21F 15/00 |

OTHER PUBLICATIONS

First Office Action issued in counterpart Chinese Patent Application No. 202410733288.7, dated Oct. 4, 2024.

Liu et al., Laboratory experiment study of grouted materials filled in karst caverns, Chinese Journal of Rock Mechanics and Engineering, vol. 38, pp. 3179-3188, dated Apr. 15, 2019.

Zhang, Mechanism of Deflection Propagation for Grouting in Fractured Rock Mass with Flowing Water and Mining Effect on Grouted Curtain: A Review, Journal of Engineering Geology, vol. 30, No. 3, pp. 987-997, dated Mar. 31, 2022.

Zhou et al., Analysis on Bearing Characteristics of Pile Groups with Post-Grouting at Pile Ends in Loess Areas, Industrial Construction, vol. 54, No. 3, pp. 182-190, dated Mar. 31, 2024.

* cited by examiner

METHOD OF SEGMENTED GROUTING FOR REPAIRING AQUIFERS IN MINING AREA

CROSS-REFERENCE TO RELATED APPLICATIONS

This application claims priority to Chinese Patent Application No. 202410733288.7, filed on Jun. 6, 2024, the content of which is incorporated herein by reference in its entirety.

TECHNICAL FIELD

This application relates to the grouting technology, particularly to a method of segmented grouting for repairing aquifers in a mining area after mining.

BACKGROUND

Coal is an important kind of natural resources. With an increasing scale of coal mining, numerous goafs have been formed underground. However, roof water inrushes may be formed in the goafs, causing a serious loss of shallow water resources. Grouting is a most commonly used technique to maintain stabilities of aquifers. That is, slurry can be pumped into an area of sudden water inrush through drilling, which may repair the aquifers effectively.

However, during a process of grouting, the slurry injected may encounter a large flow of dynamic water with a high velocity. In this situation, the slurry will be greatly diluted by the dynamic water and the split rock mass. Therefore, a retention rate of the slurry would become extremely low and a large amount of slurry would be required to achieve a restoration of the aquifers. Therefore, there is an urgent need for an aquifer restoration method which can effectively reduce the amount of slurry used for grouting.

SUMMARY

In view of this, examples of the present disclosure provide a method of segmented grouting for repairing aquifers in a mining area after mining with a low amount of slurry.

In examples of the present disclosure, the method of segmented grouting for repairing aquifers in a mining area may include: drilling a grouting hole in a ground area corresponding to a water inflow position in a goaf; performing a segmented grouting in a target grouting layer through the grouting hole; where, the segmented grouting may include: a scour and migration grouting, a splitting and diffusion grouting, and a sedimentation and compaction grouting. The scour and migration grouting may use a first slurry with a first specific gravity and a first pump volume for grouting; the splitting and diffusion grouting may use a second slurry with a second specific gravity and a second pump volume for grouting; and the sedimentation and compaction grouting may use a third slurry with a third specific gravity and a third pump volume for grouting. Where, the first specific gravity is less than the second specific gravity; the second specific gravity is less than the third specific gravity; the first pump volume is greater than the second pump volume; and the second pump volume is greater than or equal to the third pump volume. After the segmented grouting, a waiting on cement process is performed to repair the aquifers.

In examples of the present disclosure, before drilling the grouting hole, the method may further include: obtaining mining data and hydrogeological data of the goaf; and determining a drilling location and the target grouting layer based on the mining data and hydrogeological data. Specifically, the mining data may include a size of the goaf, the water inflow position, a water inflow amount, a thickness of a mining layer, a mining process, and an advancing rate of the mining face. The hydrogeological data may include a distribution status of the aquifers in the goaf, a water content of the aquifers, a status of a roof splitting zone after mining, and a status of a caving zone.

In examples of the present disclosure, drilling the grouting hole may include: drilling the grouting hole to a first depth at the drilling location; where, the first depth is less than a depth of the target grouting layer; inserting a casing pipe into the grouting hole; and fixing the casing pipe using a fourth slurry with a fourth specific gravity. Where, the fourth specific gravity is greater than the third specific gravity.

In examples of the present disclosure, after a waiting on cement process is performed on the fourth slurry, the method may further include: continuing to drill the grouting hole to an auxiliary grouting layer; grouting a fifth slurry to the auxiliary grouting layer and performing a waiting on cement process on the fifth slurry; where, the auxiliary grouting layer is located above the target grouting layer.

In examples of the present disclosure, a vertical distance between the auxiliary grouting layer and the target grouting layer is from 10 m to 15 m.

In examples of the present disclosure, grouting a fifth slurry to the auxiliary grouting layer and performing a waiting on cement process on the fifth slurry may include: grouting the fifth slurry with a fifth specific gravity into the auxiliary grouting layer according to the second pump volume; maintaining a grouting pressure stable for a first preset time; and stopping grouting and performing a waiting on cement process on the fifth slurry; where, the fifth specific gravity is greater than the first specific gravity and less than the second specific gravity.

In examples of the present disclosure, after the waiting on cement process is performed on the fifth slurry, the method may further include: continuing to drill the grouting hole to the target grouting layer; drilling multiple branch holes horizontally in the target grouting layer. In this case, performing a segmented grouting in a target grouting layer through the grouting hole may include: performing the segmented grouting in the multiple branch holes.

In examples of the present disclosure, the scour and migration grouting may include: using the first slurry with the first specific gravity to grout the target grouting layer according to the first pump volume; stopping grouting after the grouting pressure has been maintained at a first preset pressure for the first preset time.

In examples of the present disclosure, the splitting and diffusion grouting may include: after the scour and migration grouting has been completed for a second preset time, starting grouting the target grouting layer; in response to determine that the grouting pressure reaches a second preset pressure, grouting the target grouting layer with the second slurry with the second specific gravity according to the second pump volume; stopping grouting after the grouting pressure has been maintained at a third preset pressure for the first preset time, where, the second preset pressure is less than the third preset pressure.

In examples of the present disclosure, the sedimentation and compaction grouting may include: after the splitting and diffusion grouting has been completed for a second preset time, starting grouting the target grouting layer; in response to determine that the grouting pressure reaches the first preset pressure, grouting the target grouting layer with the third slurry with the third specific gravity according to the third pump volume; stopping grouting after the grouting pressure has been maintained at a fourth preset pressure for the first preset time, where, the fourth preset pressure is greater than the first preset pressure.

From the above, it can be seen that examples of the present disclosure provide a method of segmented grouting for repairing aquifers in a mining area after mining. The method may include: drilling a grouting hole in a ground area corresponding to a water inflow position in a goaf; performing a segmented grouting in a target grouting layer through the grouting hole. The segmented grouting may include: a scour and migration grouting, a splitting and diffusion grouting, and a sedimentation and compaction grouting. The scour and migration grouting may use a first slurry with a first specific gravity and a first pump volume for grouting; the splitting and diffusion grouting may use a second slurry with a second specific gravity and a second pump volume for grouting; and the sedimentation and compaction grouting may use a third slurry with a third specific gravity and a third pump volume for grouting. Where, the first specific gravity is less than the second specific gravity; the second specific gravity is less than the third specific gravity; the first pump volume is greater than the second pump volume; and the second pump volume is greater than or equal to the third pump volume. After the segmented grouting, the waiting on cement process may be further performed, therefore the aquifers may be repaired. By adjusting the specific gravity and the pump volume of the slurry, the influences on the slurry caused by the dynamic water may be reduced. Through the segmented grouting such as the scour and migration grouting, the splitting and diffusion grouting, and the sedimentation and compaction grouting, the retention rate of the slurry can be improved. Therefore, cracks can be sealed effectively, losses of shallow water resources can be reduced effectively, and the stability of the aquifers can be maintained. Compared with conventional grouting methods, the amount of slurry used for grouting can be greatly reduced too. Experiments have shown that the amount of slurry used for grouting can be reduced by up to 89%. In summary, the method of segmented grouting for repairing aquifers in a mining area after mining is simple and convenient, which can seal the cracks after mining, reduce maintenance costs, minimize the loss of shallow water resources, and maintain the stability of the aquifers effectively.

BRIEF DESCRIPTION OF THE DRAWINGS

In order to describe technical solutions of the present application or related arts more clearly, accompanying drawings required for describing examples or the related art are introduced briefly in the following. Apparently, the accompanying drawings in the following descriptions only illustrate some examples of the present application, and those of ordinary skill in the art may still derive other drawings from these drawings without creative efforts.

DETAILED DESCRIPTION OF THE EMBODIMENTS

Figure 1:
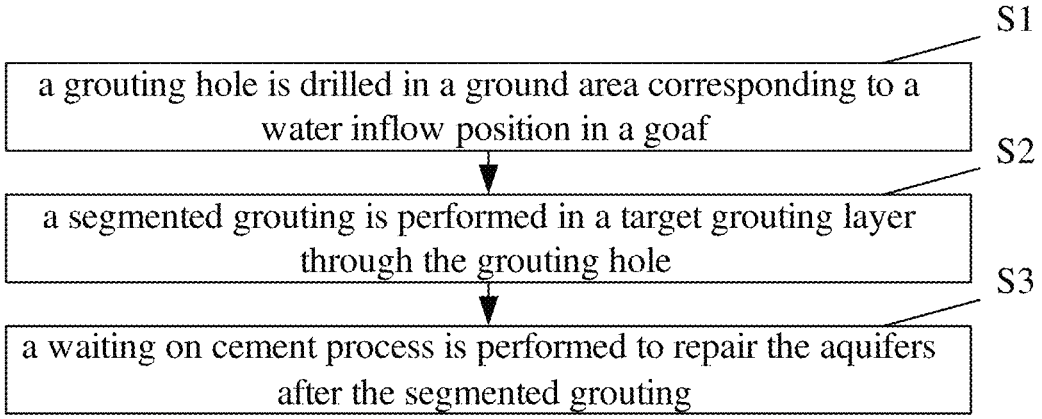
FIG. 1 is a flowchart of the method of segmented grouting for repairing aquifers in a mining area according to examples of the present disclosure.

Hereinafter, in order to make the objective(s), technical solution(s) and advantages of the present application clearer and more understandable, the present application will be further described in detail, in connection with specific embodiments and with reference to the accompanying drawings.

It is necessary to be noted that the technical terms or scientific terms used in the embodiments of the present application should have common meanings as understood by those skilled in the art of the present application, unless otherwise defined. The "first", "second" and similar words used in the embodiments of the present application do not refer to any sequence, number or importance, but are only used to distinguish different component portions. The "comprise", "include" or a similar word means that an element or item before such word covers an element or item or any equivalent thereof as listed after such word, without excluding other elements or items. The "connect" or "interconnect" or a similar word does not mean being limited to a physical or mechanical connection, but may include a direct or indirect electrical connection. The "upper", "lower", "left" and "right" are used only to indicate a relative position relation, and after the absolute position of the described object is changed, the relative position relation may be changed accordingly.

Coal is an important kind of natural resources. With an increasing scale of coal mining, numerous goafs have been formed underground. However, roof water inrushes may be formed in the goafs, causing a serious loss of shallow water resources. Grouting is a most commonly used technique to maintain stabilities of aquifers. That is, slurry can be pumped into an area of sudden water inrush through drilling, which may repair the aquifers effectively.

However, during a process of grouting, the slurry injected may encounter a large flow of dynamic water with a high velocity. In this situation, the slurry will be greatly diluted by the dynamic water and the split rock mass. Therefore, a retention rate of the slurry would become extremely low and a large amount of slurry would be required to achieve a restoration of the aquifers. Therefore, there is an urgent need for an aquifer restoration method which can effectively reduce the amount of slurry used for grouting.

As an underground concealed project, a diffusion of grouting materials is unpredictable under complex geological conditions. Currently, main grouting theories include a splitting grouting theory, a pressure grouting theory, a permeation grouting theory, an electrochemical grouting theory, and a crack grouting theory.

The splitting grouting is a grouting method that uses a high pressure to inject grout into rock and soil to increase its strength and reduce its permeability. The reinforcement and anti-seepage effect of the splitting grouting is a joint result of actions of grout and rock soil mass. The process of the splitting grouting may include stages such as bubbling and squeezing, splitting and flowing. At each stage, the slurry always exerts effects on the rock and soil, including filling diffusion, squeezing, ion exchange, and etc. After grouting, the slurry condenses in the rock and soil to form a complex network of grout veins, which can also serve as a skeleton support.

At present, a starting splitting pressure $P_d$ for grouting may be determined by using a condition that a grouting pressure inside a splitting channel is greater than a sum of a minimum principal stress $\sigma_3$ and a tensile strength $\sigma_t$ of an injected rock mass as a criterion for cracks to continue splitting and expanding forward, which can be expressed as the following formula: $P_d=\sigma_3+\sigma_t$.

The criterion may include a stress intensity factor at a tip of the crack is greater than or equal to a splitting toughness $K_{IC}$, as shown in the following formula:

$$\frac{2}{\sqrt{\pi R}}\int_0^R\sqrt{\frac{R+x}{R-x}}\,\Delta P(x)dx \geq K_{IC}$$

In the formula, $\Delta P(x)$ is a net pressure inside a crack; R is a half-length of a crack. When the slurry flows in shear, the grouting pressure inside the crack channel shows a non-uniform load distribution with attenuation. The movement of the slurry and the expansion of the splitting crack occur synchronously. On one hand, the movement law of the slurry must be followed, and on the other hand, the diffusion law of the slurry must also meet the diffusion law of the splitting crack. The compaction grouting refers to injecting a relatively large proportion of grout into the target grouting layer and squeezing it towards the cracks between the filling holes, forming grout bubbles at a grouting site. The diffusion of the grout causes compression under the stress resistance of the surrounding rock mass. The slurry completely replaces the crack space within the grouting range. Due to the high viscosity of the slurry, it is difficult for the slurry to flow freely in the cracks and requires the assistance of external pressure for grouting. As the degree of compression and compaction increases, the mechanical strength and structural stability of the injected rock layer also increase.

According to a diffusion law of the slurry, the higher the initial injection pressure, the better the diffusion performance of the slurry. However, increasing the initial injection pressure requires adjusting the injection pump volume. Generally, the larger the injection pump volume, the more slurry is released. With the increase of injection time and stable pump volume, the diffusion distance and diffusion rate of the slurry in the initial stage may increase. As the grouting process progresses, the diffusion distance continues to increase on this basis. However, due to the increase in the initial grouting pressure, the volume strain of the grout in the splitting body of the grouting layer will undergo a sudden change in volume strain at the initial moment. When the volume strain reaches a certain level, the mechanical strength of the rock layer decreases, and rock fragmentation causes further expansion of the rock splits, resulting in a splitting effect and achieving the purpose of grout diffusion.

Secondly, the pump volume and pressure also have different reaction patterns in the later stage of grouting. In order to ensure that the grouting material is fully filled in the crack development body, further regulation of the pump volume is particularly important. With the splitting effect generated by the initial grouting pressure, the final diffusion distance of the slurry has been roughly determined. At this time, the volume strain of the slurry in the rock mass will be hindered by the surrounding rocks, and the pump volume will be fed back along the conveying pipeline, resulting in an increase in pressure and an increase in the load on the grouting pump. Therefore, by adjusting the pump volume and the density of the slurry appropriately, the rate of pressure increase can be reduced.

The permeation grouting of typical water rich sand layers includes essentially a process of using grout to displace substances in pores of the injected medium. During the process of the permeation grouting, the flow rate of the pump and the pressure of the grout in the rock mass constantly affect the changes in the grout and crack channels. There are transverse cracks that connect adjacent longitudinal cracks as grout flow channels for adjacent longitudinal cracks. When the grout flow position in the dominant crack is greater than that in adjacent cracks, replenishment may occur. However, due to the complexity of pore channels, the migration of slurry may be hindered to a certain extent, resulting in adsorption and precipitation during migration, which in turn clogs the pore channels of sandstone splitting bodies. In addition, due to the complexity of pore channels in the sand layer, the impurities scattered between the pores under post mining stress disturbance and the dilution under hydraulic conditions deeply affect the diffusion range and pressure attenuation law of the grout in grouting engineering.

There are a certain number of primary splits naturally present inside the rock mass. When coal mining is disturbed, these primary splits will further develop and expand, producing a more complex network of secondary splits. However, under the long-term gravity settlement of the overlying rock mass, the rock mass damaged by mining disturbance will be compacted and re cemented into rock, and the broken splits will gradually heal, producing a self-healing effect. This process will reduce the development range and opening degree of the water conducting splits in the overlying rock, but this temporary bridging still faces accidents such as water inrush and sand collapse in the face of dynamic water erosion, expansion, and strengthened water passage.

The technical solutions of the present disclosure will be explained in detail through specific examples and in conjunction with drawings.

Examples of the present disclosure provide a method of segmented grouting for repairing aquifers in a mining area. As shown in FIG. 1, the method may include the following steps.

In S1, a grouting hole is drilled in a ground area corresponding to a water inflow position in a goaf.

In examples of the present disclosure, the ground area corresponding to the water inflow position can be determined based on experiences or relevant water inflow data. The relevant water inflow data may include a water inflow volume, a water level, and a water pressure of a sealed wall water inflow point in an underground roadway. Combined with the development law of mining overlying rock splits and results of roof water rich geophysical exploration, a distribution area of underground water inflow filling channels and a distribution of an aquifer water rich area can be determined. The ground area corresponding to the water inflow location can be finally determined. Alternatively, the ground area can be directly determined straight above the water inflow position. After the ground area is determined, a grouting hole can be drilled for the subsequent segmented grouting operations.

In S2, a segmented grouting is performed in a target grouting layer through the grouting hole.

In examples of the present disclosure, the segmented grouting may include: a scour and migration grouting, a splitting and diffusion grouting, and a sedimentation and compaction grouting. Specifically, the scour and migration grouting may use a first slurry with a first specific gravity and a first pump volume for grouting; the splitting and diffusion grouting may use a second slurry with a second specific gravity and a second pump volume for grouting; and the sedimentation and compaction grouting may use a third slurry with a third specific gravity and a third pump volume for grouting. Where, the first specific gravity is less than the second specific gravity; the second specific gravity is less than the third specific gravity; the first pump volume is greater than the second pump volume; and the second pump volume is greater than or equal to the third pump volume.

After mining, it takes a certain amount of time for split channels in the split rock layers to perform a self-repair. However, a safety of coal mining production cannot be guaranteed during this period. Therefore, during the period from mining to the implementation of grouting treatment, the disturbance of split healing may not be complete. In the process of dynamic water migration, small particles carried by the water flow and impurities in channels may scatter and adhere to inner walls of water channels, which may hinder the movement of the slurry directly, causing a blockage of stagnant and accumulated slurry at a front end of a split, which cannot meet the needs of diffusion treatment. Therefore, it is necessary to use a grouting pump to inject a small proportion of slurry into the grouting hole by capping it, replacing the drilling fluid on the inner wall of the grouting hole. Therefore, impurities between larger cracks may be scoured and migrated through a large pump volume. Therefore, the scour and migration grouting mainly focuses on a method of grouting using a slurry with "a small specific gravity and a large pumping volume" to scour attachments and channels at front ends of the cracks.

Figure 3:
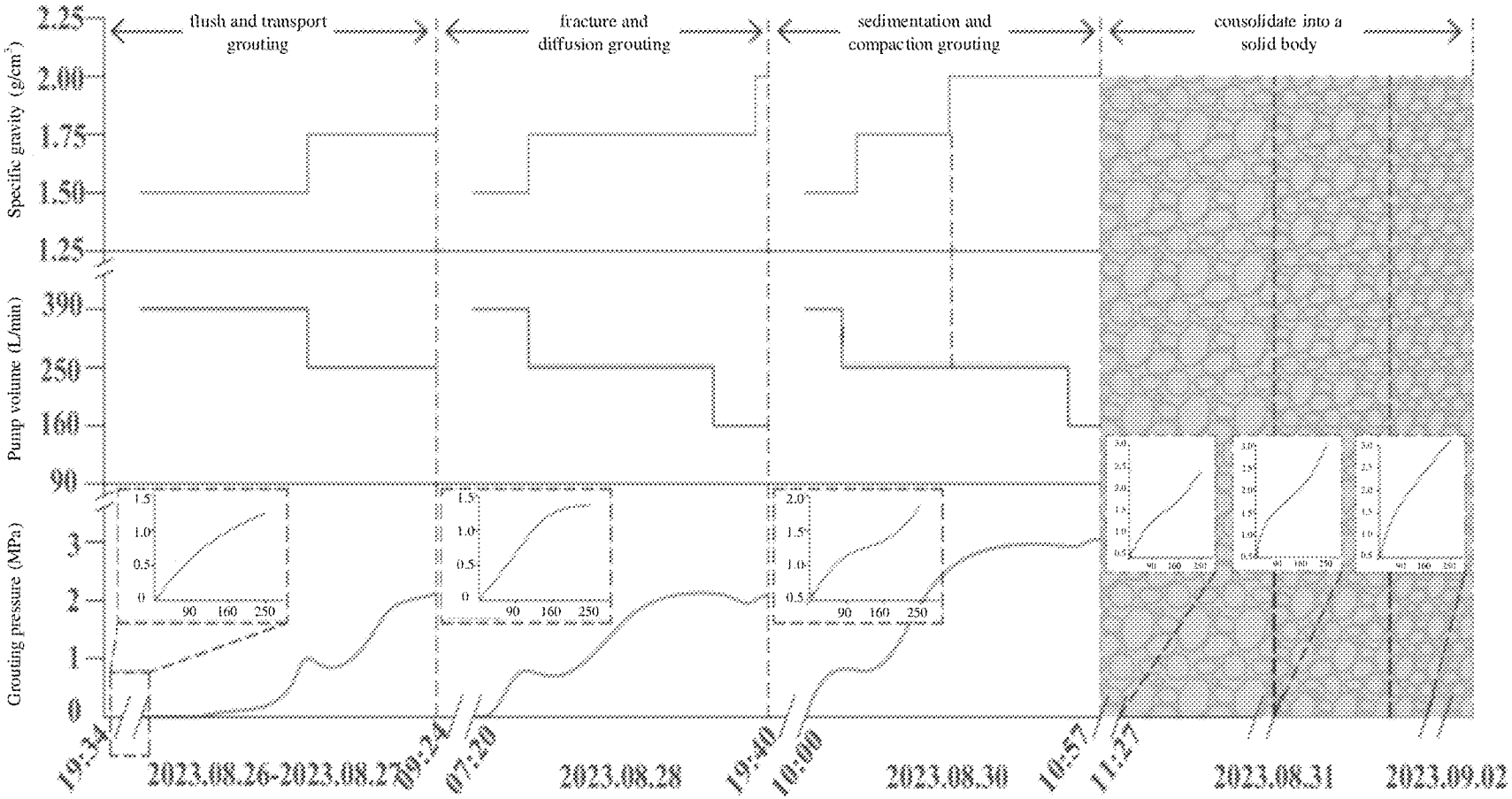
FIG. 3 is a schematic diagram of a testing process of the segmented grouting.

During the scour and migration grouting stage, it is not only about scour and migration of attachments and impurities in crack channels, but also about expansions and splitting of unfilled cracks. The first specific gravity is, for example, 1.5 g/cm$^3$, and the first pump volume is, for example, 390 L/min, which is not limited in detail. As shown in FIG. 3, during a 12 hour water pressure test after the scour and migration grouting, an initial pressure before grouting would increase very fast and remain stable afterwards, indicating that a reinforcement effect of front cracks is good and channel impurities were thoroughly scoured.

Based on experiences, a higher specific gravity combined with an external force makes it easier to achieve the split pressure of cracks. However, with a high specific gravity, the viscosity of the slurry may be high, making it difficult to move at the front ends of small cracks. Therefore, the splitting and diffusion grouting may focus on continuous splitting and diffusion using a slurry with "a medium specific gravity and a medium pump volume". The second specific gravity is, for example, 1.75 g/cm$^3$, and the second pump volume is, for example, 250 L/min, with no specific limitations. Under actions of dynamic water scouring, there is less residual slurry in the water channels, but it still needs to be tested by a water pressure test to verify a grouting effect during the splitting and diffusion grouting stage. Another function is to scour and replace solidified slurry on the inner wall of the borehole, and clear the water channels.

The sedimentation and compaction grouting may be carried out using a slurry with "a high specific gravity and a medium pump volume or a small pump volume" to fill and reinforce the water channels and further compact the grout at the front ends of the cracks to achieve a sedimentation and compaction. The third specific gravity is, for example, 2.0 g/cm$^3$, and the third pump volume is, for example, 250 L/min or 160 L/min, with no specific limitations. As the degree of compression increases, erosion may be further reduced, and the mechanical strength and structural stability of the grouting layer may also be enhanced, improving the retention and consolidation of the slurry in the channels under dynamic water dilution.

By adjusting the specific gravity and the pump volume of the slurry, the influences on the slurry caused by the dynamic water may be reduced. Through segmented grouting operations such as scour and migration grouting, splitting and diffusion grouting, and sedimentation and compaction grouting, the slurry retention rate may be improved, cracks may be sealed effectively, shallow water resource loss may be reduced effectively, and the stability of the aquifers can be maintained. Compared with conventional grouting methods, the grouting volume can be greatly reduced. Experiments have shown that the grouting volume can be reduced by up to 89%.

In S3, a waiting on cement process is performed to repair the aquifers after the segmented grouting.

After the segmented grouting, a 12-hour waiting on cement process would be performed to stabilize a solidified skeleton of the slurry. As shown in FIG. 3, immediately after the sedimentation and compaction grouting is completed, a water pressure testing may be carried out. In the test, the water pressure rises rapidly, with a steep and straight curve, meeting the grouting completion criteria. During the waiting on cement period, the cracks are filled with grout gradually. As the waiting time increases, consolidations in the cracks become stronger, therefore, the front ends of the cracks may become denser, forming a whole.

As can be seen, the method of segmented grouting for repairing aquifers in a mining area is simple and convenient, which can seal the cracks after mining, reduce maintenance costs, minimize losses of shallow water resources, and maintain a stability of the aquifers effectively.

In some examples, before step S1, the method may further include the following steps.

Firstly, mining data and hydrogeological data of the goaf are obtained.

Specifically, the mining data may include a size of the goaf, the water inflow position, a water inflow amount, a thickness of a mining layer, a mining process, and an advancing rate of the mining face. The hydrogeological data may include a distribution status of the aquifer in the goaf, a water content of the aquifer, a status of a roof splitting zone after mining, and a status of a caving zone.

Secondly, a drilling location and the target grouting layer are determined based on the mining data and hydrogeological data.

Based on the mining data and the hydrogeological data, density and distribution characteristics of mining induced splits in the roof after mining can be determined through numerical simulation and theoretical analysis. Moreover, the drilling location and the target grouting layer may be selected. This will not be elaborated here.

In some examples, the above step S1 may include the following steps.

Firstly, the grouting hole is drilled to a first depth at the drilling location. Where, the first depth is less than a depth of the target grouting layer.

Secondly, a casing pipe is inserted into the grouting hole.

Thirdly, the casing pipe is fixed with a fourth slurry with a fourth specific gravity. Where, the fourth specific gravity is greater than the third specific gravity.

According to design coordinates, a 215 m hard alloy drill bit may be selected to drill a hole down to a depth of 90 m, which is the first depth (the depth of a top interface of the target grouting layer). A 168 mm casing pipe is inserted, and a single liquid cement slurry (the fourth slurry) is used to fix the casing pipe. The fourth specific gravity of the fourth slurry is 2.10 g/cm$^3$. The fourth slurry is injected under the cover until it returns to a hole opening. The time period of the waiting on cement process is 48 hours. Then, a pipeline water-tight test may be carried out on the casing pipe. In response to determining that the pump volume can be maintained as no less than 48 L/min and the pressure can be maintained as no less than 7 MPa for 10 minutes, the pipeline water-tight test can be considered as qualified. If the test is not qualified, the casing pipe may be re-drilled or pulled out.

In examples of the present disclosure, after the waiting on cement process of the fourth slurry, the method may further include the following steps.

Fourthly, the grouting hole is further drilled to an auxiliary grouting layer. Where, the auxiliary grouting layer is located above the target grouting layer.

Fifthly, a fifth slurry is grouted to the auxiliary grouting layer and a waiting on cement process is performed.

Figure 2:
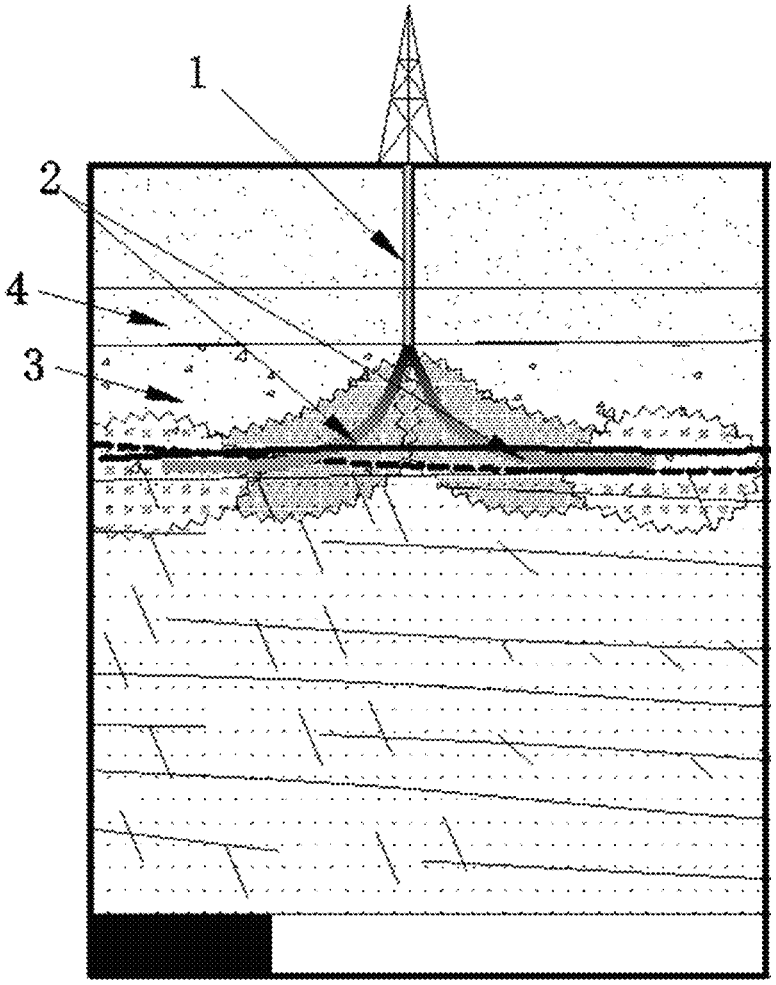
FIG. 2 is a schematic diagram of a cross-section of a goaf.

After the solidification of the casing pipe, as shown in FIG. 2, the grouting hole 1 may be further drilled to the auxiliary grouting layer 4. The auxiliary grouting layer 4 is located above the target grouting layer 3. Before the segmented grouting of the target grouting layer 3, grout may be injected into the auxiliary grouting layer 4 to fully fill and reinforce the cracks at the top of the target grouting layer 3, which forms a grouting dome on the plane. This achieves a reduction in the supply of shallow water layers to the overlying water layer of the coal seam, while reducing the interference of dynamic water during subsequent segmented grouting. It is also easier to drill into branch holes 2, solving the problem caused by collapse of branch holes 2. After the grouting reinforcement in the auxiliary grouting layer 4, the branch holes 2 can prevent the slurry from running upward to the ground, and can also promote the slurry to move horizontally and downwards to solve the problem of grout running randomly during the grouting process.

After a grouting completion standard is met and a waiting on cement process is performed for the auxiliary grouting layer, the grouting hole may be further drilled to the target grouting layer. The segmented grouting method is used to achieve crack sealing, minimize replenishment, transform the grouting rock layer, protect the ecological water level of the shallow aquifer, and reduce interference with the mine.

In examples of the present disclosure, a vertical distance between the auxiliary grouting layer and the target grouting layer may be from 10 m to 15 m. This vertical distance cannot be too short or too long. If the vertical distance is too short, the cracks in the target grouting layer may be blocked first, therefore, the diffusion of the slurry would be affected in the segmented grouting. However, if the vertical distance is too long, the top of the target grouting layer cannot be blocked effectively, the slurry would run upwards in the segmented grouting.

In examples of the present disclosure, the step of grouting the fifth slurry to the auxiliary grouting layer may include the following steps.

At first, the fifth slurry with a fifth specific gravity is grouted into the auxiliary grouting layer according to the second pump volume. Where, the fifth specific gravity is greater than the first specific gravity and less than the second specific gravity.

Then, the grouting pressure is maintained stable for a first preset time before stopping grouting.

At last, grouting would be stopped and a waiting on cement process is performed on the fifth slurry.

The auxiliary grouting layer is mainly used to block top cracks and suppress unstable upward diffusions of the grout in the target grouting layer. Therefore, ordinary silicate P.O42.5 cement, water and clay (5000 mesh) can be selected as the grout. Under the aforementioned split rock layers, crack openings are large, connections between the cracks are complex, and particles in the cracks are obvious. Therefore, a constant specific gravity and a pump volume can be used to continuously and stably scour impurities in the cracks. The fifth specific gravity is, for example, 1.55 g/cm$^3$, and the second pump volume is, for example, 250 L/min. When the pressure rises to 1 to 1.5 times of a static water pressure, the pump volume can be adjusted appropriately to stabilize the grouting pressure. The first preset time is, for example, 40 minutes. After the grouting pressure has maintained stable for about 40 minutes, a grouting complete standard of the auxiliary grouting layer is met. Therefore, the grouting can be stopped and a 24-hour waiting on cement process may be performed to achieve a goal of reducing the overflow supply of shallow aquifers and horizontal diffusions of the grout in the target grouting layer can be controlled.

In examples of the present disclosure, after the waiting on cement process of the fifth slurry, the method may further include the following steps.

At first, the grouting hole is further drilled to the target grouting layer.

Then, multiple branch holes are drilled horizontally in the target grouting layer.

In this situation, the segmented grouting may be performed in the multiple branch holes. To be noted, the segmented grouting through multiple branch holes may expand a grouting range and improve a sealing effect.

In examples of the present disclosure, the scour and migration grouting may include the following steps.

Further, the first slurry with the first specific gravity is used to grout the target grouting layer according to the first pump volume.

At last, the grouting is stopped after a grouting pressure has been maintained at a first preset pressure for the first preset time.

As shown in FIG. 2, during the scour and migration grouting stage, in order to achieve unobstructed movements of the diluted slurry in the pores and strengthen the crack channels under a high pump volume, injection parameters may be mainly controlled at a slurry density of 1.5 g/cm3 and a pump volume of 390 L/min, which serves as the foundations for the next stage of the splitting and diffusion grouting.

As can be understood, the increase in the grouting pressure in this section may be slow and gradual, and the duration is relatively long. When the grouting pressure reaches about 1 Mpa, it indicates that the specific gravity of the slurry at this time is difficult to carry attachments, and an increased specific gravity makes it difficult for the grouting pump to load. At this time, the specific gravity can be adjusted to 1.75 g/cm$^3$ and the pump volume can be adjusted to 250 L/min. After the adjustments, the grouting pressure makes a brief decrease, and then rapidly continues to rise. The first preset pressure is, for example, 2 MPa, and the first preset time is, for example, 30 minutes. When the grouting pressure has been maintained stable above 2 MPa for 30 minutes, the scour and migration grouting stage may be completed to ensure the filling and reinforcement of the front ends of the cracks.

In examples of the present disclosure, the splitting and diffusion grouting may include the following steps.

After the scour and migration grouting has been completed for a second preset time, the target grouting layer is further grouted.

In response to determine that the grouting pressure reaches a second preset pressure, the target grouting layer is further grouted with the second slurry with the second specific gravity according to the second pump volume.

Further, the grouting is stopped after the grouting pressure has been maintained at a third preset pressure for the first preset time. Where, the second preset pressure is less than the third preset pressure.

The second preset time may be, for example, 12 hours. After the scour and migration grouting has been completed for the second preset time, grouting for the target grouting layer can be restarted. The previous stage solidified slurry can be quickly scoured and migrated with a slurry with "a large pump volume and a small specific gravity". The second preset pressure, for example, can be 1 MPa. When the grouting pressure rapidly rises to 1 MPa, adjust the slurry specific gravity to 1.75 g/cm$^3$ and the pump capacity to 250 L/min for grouting. Under the above grouting parameters, fissure channels can be grouted for a long time. In this way, through compactions and fracturing flows, actions can be applied to the rock and soil mass through the slurry bubbling, therefore, the dilution under dynamic water can be overcome, and the fracturing diffusion can be completed. The third preset pressure is, for example, 1.5 MPa. When the grouting pressure remains stable above 1.5 MPa for 30 minutes, the splitting and diffusion grouting stage ends, which can also serve as a skeleton support to promote the subsequent grouting.

In examples of the present disclosure, the sedimentation and compaction grouting may include the following steps.

After the splitting and diffusion grouting has been completed for a second preset time, the target grouting layer is further grouted.

In response to determining that the grouting pressure reaches the first preset pressure, the target grouting layer is grouted with the third slurry with the third specific gravity according to the third pump volume.

Further, the grouting is stopped after the grouting pressure has been maintained at a fourth preset pressure for the first preset time. Where, the fourth preset pressure is greater than the first preset pressure.

After waiting for the second preset time after the splitting and diffusion grouting has completed, the grouting may be re-started on the target grouting layer, with a specific gravity of 2.0 g/cm$^3$ and a pump volume of 250 L/min. The water channel is filled and reinforced, and the front ends of the cracks may be further compacted with grout to achieve sedimentation and compaction.

At this stage, the crack channels can be further scoured and accumulated at the front ends using a slurry with "a small specific gravity and a large pumping capacity". When the grouting pressure reaches around 1 Mpa, the specific gravity can be adjusted to 1.75 g/cm$^3$ and the pumping capacity can be adjusted to 250 L/min to achieve a rapid sedimentation of the slurry in the water channels. The first preset pressure is, for example, 2 Mpa. When the grouting pressure rises to 2 Mpa, in order to cover and compact the slurry in the early stage, a slurry with "a high specific gravity and a medium pump volume" may be used for grouting. That is, a slurry with a specific gravity of 2.0 g/cm$^3$ and a pump volume of 250 L/min may be used for grouting. Due to the high specific gravity of the slurry, it is difficult for the slurry to flow freely in the cracks. When the grouting pressure stabilizes above 2.8 MPa, the pump volume can be adjusted to 160 L/min for auxiliary grouting. With the increase of compression and compaction degree, the erosion may be further reduced, and the mechanical strength and structural stability of the grouting layer may also be enhanced, improving the retention and consolidation of the slurry in the pore channels under dilution of the dynamic water. The fourth preset pressure is, for example, 3 MPa. When the grouting pressure maintains stable above 3 MPa for 30 minutes, the sedimentation and compaction grouting may be completed.

In some examples, the method of segmented grouting for repairing aquifers in a mining area after a mining process can be applied to the weak or missing red soil area. The treatment layer is the upper part of the weathered bedrock after mining, and the overlying rock layer of the coal scam in this area is with a depth of 287 m. The treatment layer is less than 100 m from the ground, and clay cement slurry is selected for grouting. The grouting process is described in sequence according to the scour and migration grouting, the splitting and diffusion grouting, and the sedimentation and compaction grouting.

Figure 4:
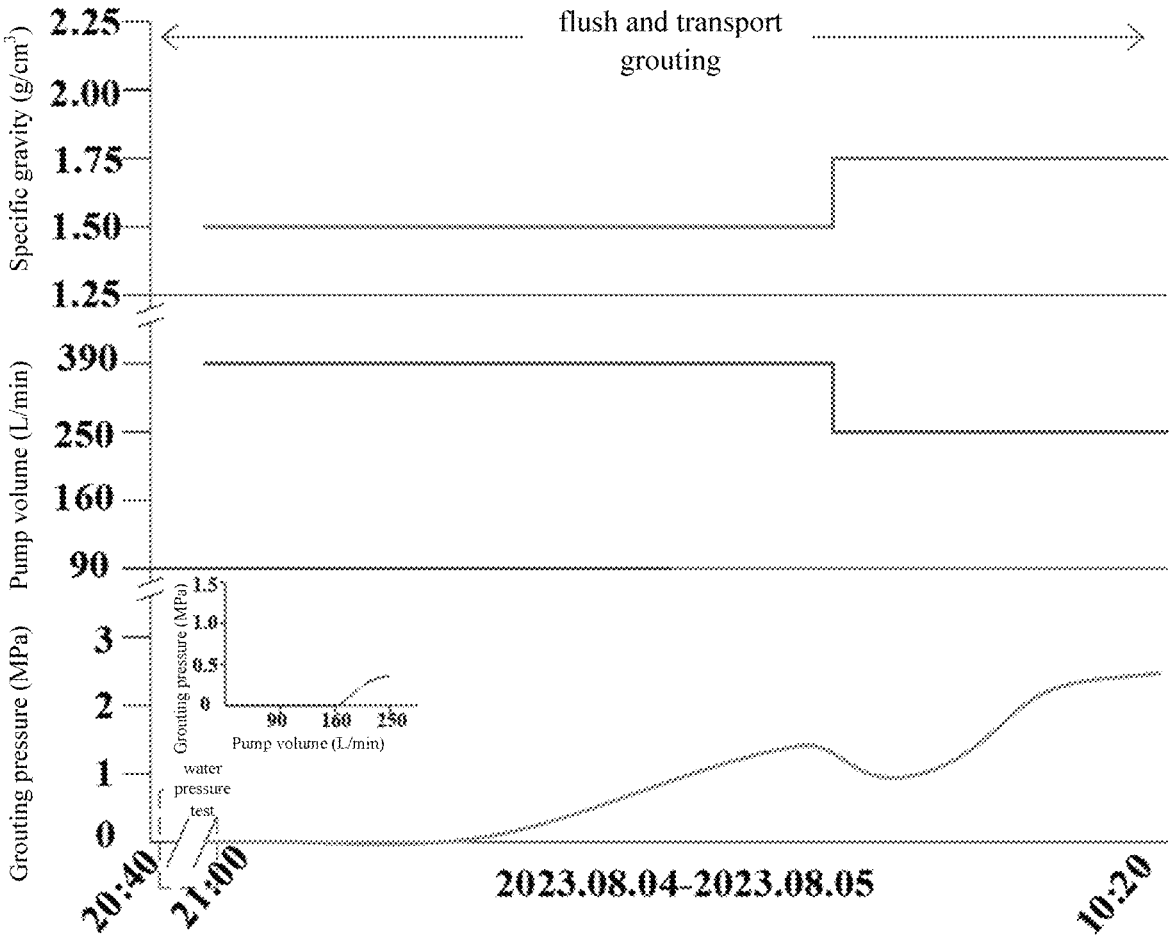
FIG. 4 is a schematic diagram of a testing process of the scour and migration grouting.

As shown in FIG. 4, for the purpose of scour and migration grouting, taking the Z1-7-3 branch hole in the treatment area as an example, the hole is 135 m long and the drilling point is on the upper part of weathered bedrock. At a depth of 103 m, the drilling fluid did not flow back into the hole and leaked out completely. There were signs of grout leakage towards adjacent holes in the same row of holes Z1-4 (to eliminate interference from grout leakage, grouting and drilling should not be carried out synchronously). In the water pressure test after completion of drilling the hole, the pump volume gradually increased to 160 L/min, indicating that the formation where the hole is located is split and connected to the water channel horizontally.

In the case of concentrated development of water channels, it is particularly important to carry out the scour and migration grouting first. Unfinished cracks or micro particle impurities carried by gravity collapse and dynamic water action may affect the subsequent diffusion of the slurry greatly. Under the "small specific gravity and large pump volume" grouting method, the pressure of the hole increases slowly, working on fracturing the front ends of the cracks and channel scouring. After increasing the specific gravity, the grouting pressure may be stabilized at above 2 MPa.

Figure 5:
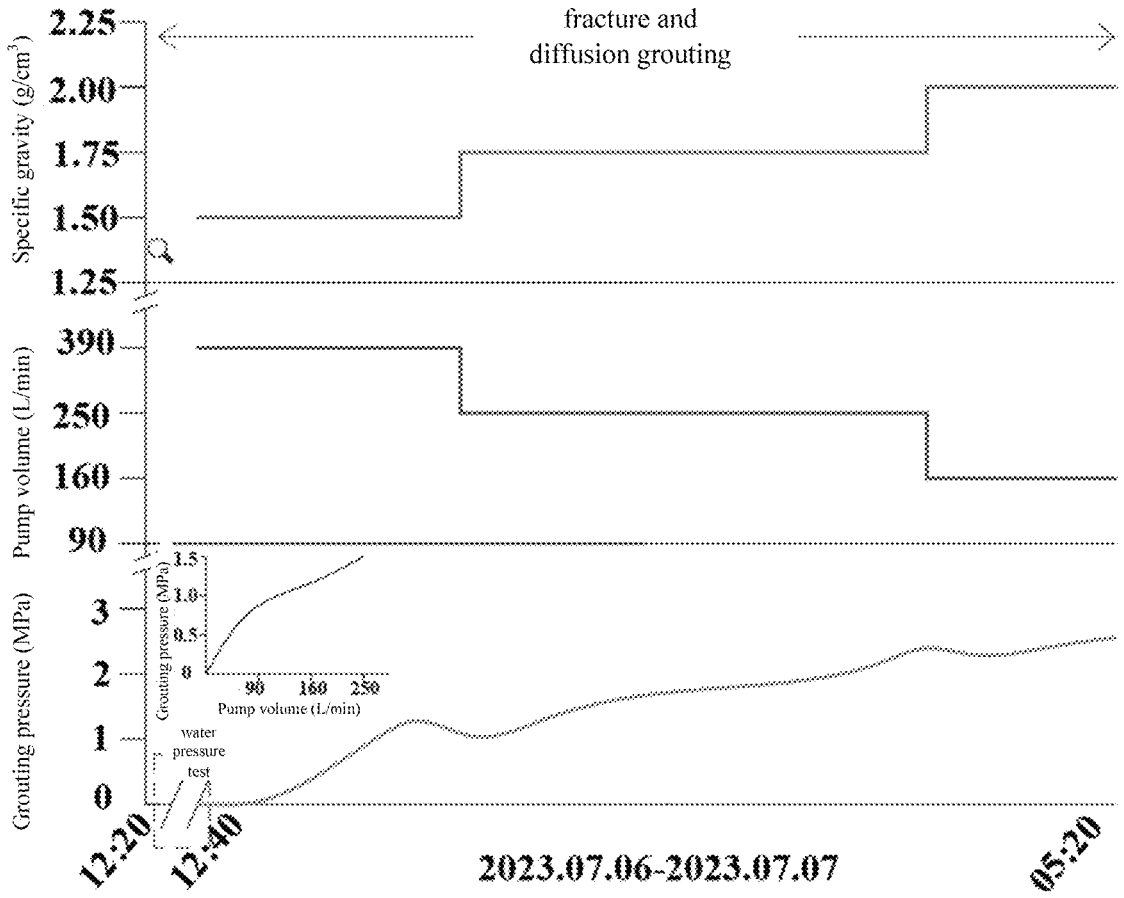
FIG. 5 is a schematic diagram of a testing process of the splitting and diffusion grouting.

As shown in FIG. 5, for the splitting and diffusion grouting, taking the Z1-5-1 branch hole in the treatment area as an example, the hole is 130 m long and the drilling point is on the upper part of weathered bedrock. The hole lost 0.8 m$^3$ of the drilling fluid from 95.71 m to 110 m and lost 2.4 m$^3$ of the drilling fluid from 110.9 m to 122.9 m, indicating a presence of significant split channels at these two locations. After the completion of the scour and migration grouting, it can be seen from the pressure curve of the water pressure test that the grouting pressure increases quickly and reaches a final pressure of 1.5 MPa. At this stage, relying on the "medium specific gravity and medium pump volume" slurry, the grouting pressure rises steadily, and the slurry bubbles, squeezes, moves, splits, and diffuses.

Figure 6:
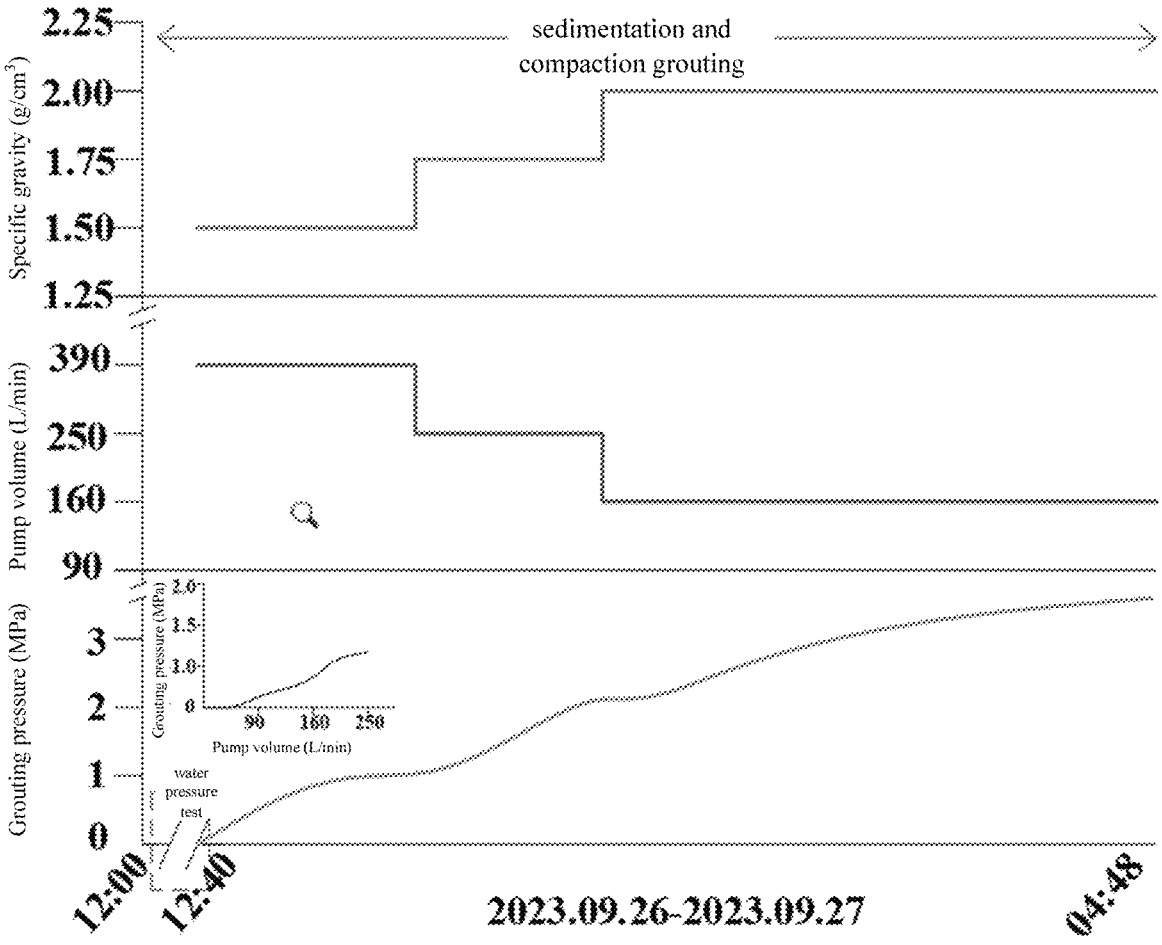
FIG. 6 is a schematic diagram of a testing process of the sedimentation and compaction grouting.

As shown in FIG. 6, for the sedimentation and compaction grouting, taking the Z3-10-3 branch hole in the treatment area as an example, the hole is 141 m long and the drilling point is on the upper part of weathered bedrock.

When drilling into the horizontal section, the drilling fluid returned clay-cement grout, which was analyzed to be from the Z1-10-2 injection hole on the same side. After the injection in this hole was completed, the drilling may be continued. In addition, the drilling fluid leaked and consumed 1.3 $m^3$ from 95.15 m to 100 m in the Z3-10 straight hole. The branch hole Z3-10-1 has a leakage consumption of 0.7 $m^3$ from 105.09 m to 106.09 m, while the branch hole Z3-10-3 has a leakage consumption of 2.8 $m^3$ from 106.79 m to 137.61 m. It can be inferred that the horizontal section of the formation in this area has a weak strength and interconnected splits. From the water pressure curve of the splitting and diffusion grouting, the trend of the line is stable, and the filling effect after fracturing is significant. With the adjustment to the "high specific gravity and low pump volume" slurry, the grouting pressure once increased to 3.7 MPa, supplementing the compaction sedimentation effect and further improving the retention and consolidation of the slurry.

Figure 7:
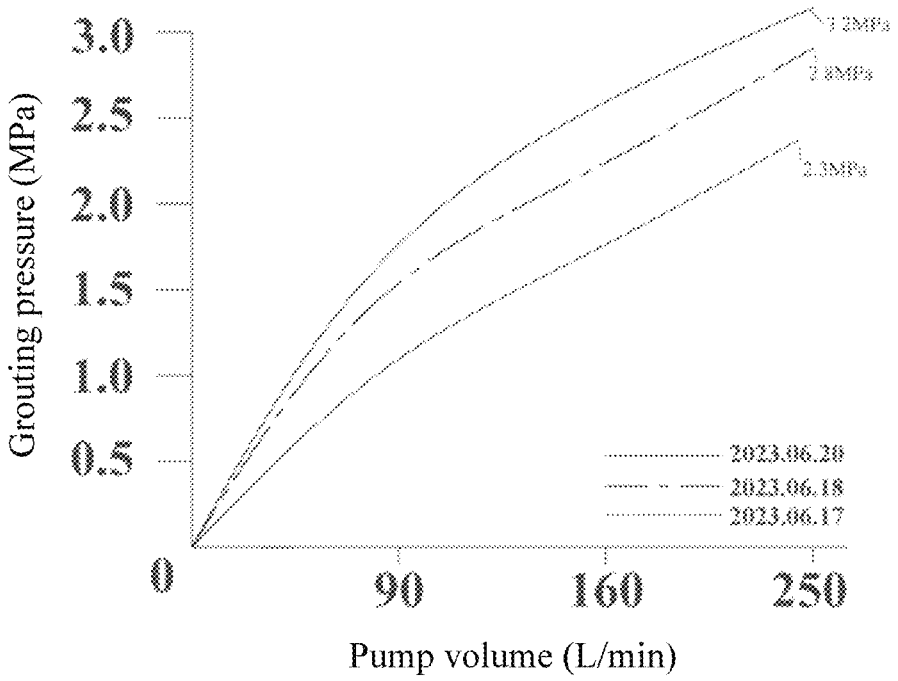
FIG. 7 is a schematic diagram of a water pressure test.

In FIG. 7, the branch hole Z3-3-2 in the treatment area is taken as an example. The hole is 130 m long and the drilling point is on the upper part of the weathered bedrock. During the drilling of the straight hole section from 78.35 m to 100 m, the leakage and consumption of this hole reached a maximum value of 8.45 $m^3$. The branch holes of the straight hole Z3-3 have leakage consumptions from 104.21 m to 110 m, from 110.42 m to 122.4 m, and from 108.7 m to 128.4 m. The leakage location is in the fissure zone at the top of weathered bedrock, with concentrated development of fissures and horizontal connectivity. The hole was subjected to water pressure tests at intervals of 1 day and 3 days after the sedimentation and compaction grouting. As time goes by, the slope of the initial pressure and the final pressure increase with time. After the slurry stagnates, it expands, tightens the crack wall, solidifies into a body, and achieves aquifer repair. after segmented grouting and the waiting on cement process, In the conventional grouting process, a segmented downward cement filling grouting method is generally used, in which the cement slurry is uniformly injected into the borehole through a grouting pump and grouting pipeline to fill, infiltrate, and compact the water and gas in the rock fissures or between soil particles. After hardening, the rock and soil in the diffusion range are bonded into a whole, forming a rock mass with high strength, low compressibility, high impermeability, and good stability, thereby reinforcing the grouting treatment layer to prevent or reduce infiltration and uneven settlement.

The specific process, such as drilling in the second section (the drilling channel after entering the casing pipe and waiting on cement), uses segmented downward grouting with a plug inside the hole. The preliminary design unit grouting section is 10 m to 20 m long, and simple hydrological observation is carried out. Finally, a high-pressure grouting is carried out on the borehole.

In a pre-injection water pressure test, after setting the casing pipe, the injection hole may be drilled downwards with a section length controlled between 10 m and 20 m. One or two drill rods can be lifted, connected to the grout stopper, and lowered to the initial drilling point. Clear water may be pumped in by the injection pump and injected through the injection pipeline and the drill rod. Based on the results of the water pressure test, the injection flow rate and specific gravity can be determined.

Segmented downward grouting may be carried out inside the hole, with the original drill rod connection unchanged. The cement slurry may be injected through the grouting pipeline and drill rod without lifting the drill. After reaching the standard for grouting completion (usually 2 to 3 times the static water pressure, and the water pressure is stabilized for 30 minutes), the drill can be lifted and allowed to set for 24 hours. After completing the segmented grouting, the hole may be scanned and drilling may be continued for 10 m to 20 m to the end point of the previous grouting section. Previous steps may be repeated until the segmented grouting is completed and the hole is sealed.

The main grouting materials may include water and ordinary silicate P O42.5 cement, with a cement slurry density of 1.1-1.3 $g/cm^3$.

Figure 8:
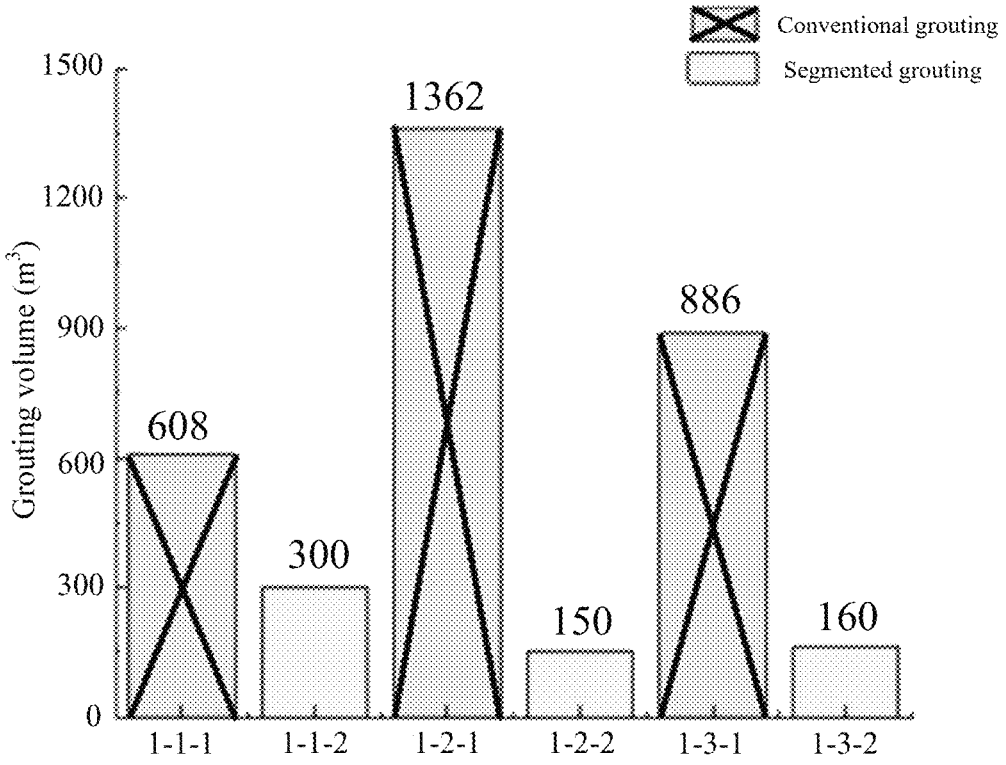
FIG. 8 is a schematic diagram illustrating a comparison of grouting volumes between the segmented grouting and a conventional grouting.
Figure 9:
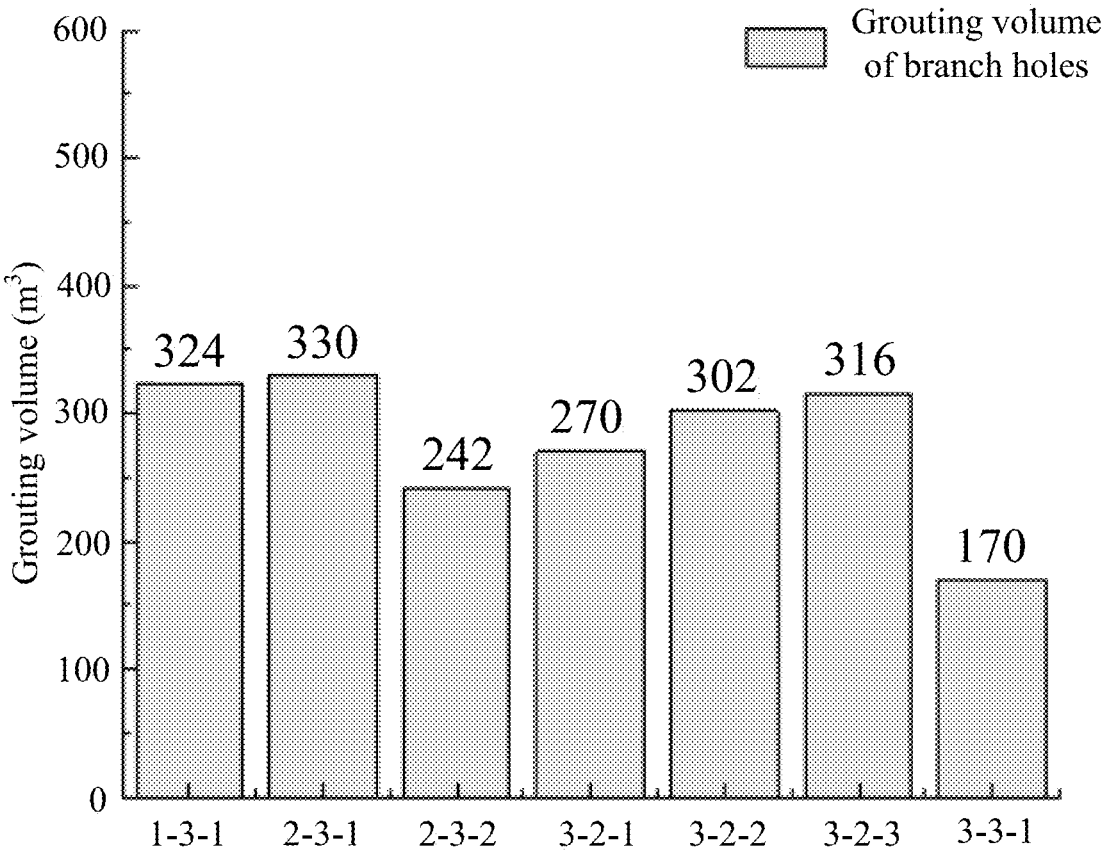
FIG. 9 is a schematic diagram illustrating a comparison of grouting volumes of multiple branch holes using the segmented grouting.

A comparative experiment was conducted using conventional grouting techniques and the method of segmented grouting for repairing aquifers in the mining area proposed by examples of the present disclosure. The experimental results are shown in FIG. 8. branch hole 1-1-1 and branch hole 1-1-2 are different branch holes of the same grouting hole 1-1, branch hole 1-2-1 and branch hole 1-2-2 are different branch holes of the same grouting hole 1-2, and branch hole 1-3-1 and branch hole 1-3-2 are different branch holes of the same grouting hole 1-3. It can be seen that the grouting amount used in this method is significantly lower than that in conventional grouting methods. The method disclosed can reduce the grouting amount by up to 89%. In addition, a comparation in grouting of different branch holes is shown in FIG. 9. In FIG. 9, branch hole 2-3-1 and branch hole 2-3-2 are different branch holes of the same grouting hole 2-3, while branch hole 3-2-1, branch hole 3-2-2, and branch hole 3-2-3 are different branch holes of the same grouting hole 3-2. It can be seen that the grouting amount is not significantly different, indicating a stable grouting effect.

It should be noted that only some examples of the present disclosure have been described above. Other examples are also within the scope of the present disclosure. In some cases, the actions or steps described may be performed in a different order and still achieve the desired results. In addition, the process depicted in any of the drawings does not necessarily require a specific or continuous order to achieve the desired results. In some implementations, multitasking and parallel processing are also possible or may be advantageous.

Ordinary technical personnel in the relevant field should understand that the discussion of any of the above examples is only exemplary and is not intended to imply that the scope of the present application is limited to these examples. Under the concept of the present disclosure, the technical features of the above examples can also be combined, and the steps can be implemented in any order. There are many other variations of the different aspects of examples of the present disclosure as described above, which are not provided in detail for the sake of simplicity.

In addition, to simplify the explanations and discussions, and to avoid making the examples of the present disclosure difficult to understand, well-known power/ground connections with other components may or may not be shown in the provided drawings. In addition, the device can be shown in the form of a block diagram to avoid making the examples of the present disclosure difficult to understand, and this also takes into account the fact that the details of the implementation of these block diagram devices are highly dependent on the platform on which the examples of the present disclosure will be implemented (i.e., these details should be fully within the understanding of those skilled in the art). After elaborating on the specific details to describe the exemplary examples of the present disclosure, it is obvious to those skilled in the art that the examples of the present disclosure can be implemented without these specific details or with changes in these specific details. Therefore, these descriptions should be considered illustrative rather than restrictive.

Although the present application has been described in conjunction with specific examples, many substitutions, modifications, and variations of these examples will be apparent to those skilled in the art based on the preceding description. The examples of the present disclosure are intended to cover all such substitutions, modifications, and variations falling within the broad scope of the appended claims. Therefore, any omission, modification, equivalent substitution, improvement, etc. made within the spirit and principles of the examples of the present disclosure should be included in the scope of protection of this application.

What is claimed is:

1. A method of segmented directional grouting for repairing aquifers in a mining area, comprising:

drilling a grouting hole in a ground area corresponding to a water inflow position in a goaf;

performing a segmented grouting in a target grouting layer through the grouting hole; wherein, the segmented grouting comprises: a scour and migration grouting, a splitting and diffusion grouting, and a sedimentation and compaction grouting; the scour and migration grouting uses a first slurry with a first specific gravity and a first pump volume for grouting; the splitting and diffusion grouting uses a second slurry with a second specific gravity and a second pump volume for grouting; and the sedimentation and compaction grouting uses a third slurry with a third specific gravity and a third pump volume for grouting; the first specific gravity is less than the second specific gravity and less than the third specific gravity; the first pump volume is greater than the second pump volume and greater than or equal to the third pump volume; wherein, the scour and migration grouting comprises: grouting the target grouting layer using the first slurry with the first specific gravity according to the first pump volume; maintaining a grouting pressure stable at a first preset pressure for a first preset time; and stopping grouting; the splitting and diffusion grouting comprises: continuing to grout the target grouting layer after the scour and migration grouting has been completed for a second preset time; in response to determining that the grouting pressure has reached a second preset pressure, grouting the target grouting layer using the second slurry with the second specific gravity according to the second pump volume; maintaining the grouting pressure stable at a third preset pressure for the first preset time and stopping grouting; wherein, the second preset pressure is less than the third preset pressure and less than the first preset pressure; the sedimentation and compaction grouting comprises: continuing to grout the target grouting layer after the splitting and diffusion grouting has been completed for the second preset time; in response to determining that the grouting pressure has reached the first preset pressure, grouting the target grouting layer using the third slurry with the third specific gravity according to the third pump volume; maintaining the grouting pressure stable at a fourth preset pressure for the first preset time and stopping grouting; wherein, the fourth preset pressure is greater than the first preset pressure; during the scour and migration grouting, injection parameters are controlled at a specific gravity of 1.5 g/cm$^3$ and a pump volume of 390 L/min serving as foundations for the splitting and diffusion grouting to achieve unobstructed movements of the diluted slurry in pores and strengthen crack channels under a high pump volume; when the grouting pressure reaches about 1 Mpa, the specific gravity is adjusted to 1.75 g/cm$^3$ and the pump volume is adjusted to 250 L/min; the grouting pressure makes a brief decrease after the adjustments and then rapidly continues to rise; the first preset pressure is 2 MPa, and the first preset time is 30 minutes; when the grouting pressure has been maintained stable above 2 MPa for 30 minutes, the scour and migration grouting stage is completed; and performing a waiting on cement process to repair the aquifers after the segmented grouting.

2. The method of segmented directional grouting for repairing aquifers in a mining area according to claim 1, wherein, before drilling the grouting hole in the ground area corresponding to the water inflow position in the goaf, the method further comprises:

obtaining mining data and hydrogeological data of the goaf; wherein, the mining data comprises: a size of the goaf, the water inflow position, a water inflow amount, a thickness of a mining layer, a mining process, and an advancing rate of the mining face; the hydrogeological data comprises: a distribution status of the aquifers in the goaf, a water content of the aquifers, a status of a roof split zone after mining, and a status of a caving zone; and determining a drilling location and the target grouting layer based on the mining data and hydrogeological data.

3. The method of segmented directional grouting for repairing aquifers in a mining area according to claim 2, wherein, drilling the grouting hole in the ground area corresponding to the water inflow position in the goaf comprises:

drilling the grouting hole at the drilling location to a first depth; wherein, the first depth is less than a depth of the target grouting layer; and inserting a casing pipe into the grouting hole; and fixing the casing pipe with a fourth slurry with a fourth specific gravity; wherein, the fourth specific gravity is greater than the third specific gravity.

4. The method of segmented directional grouting for repairing aquifers in a mining area according to claim 3, wherein, before performing the segmented grouting in the target grouting layer through the grouting hole, the method further comprises:

drilling the grouting hole further to an auxiliary grouting layer after waiting on cement; wherein, the auxiliary grouting layer is located above the target grouting layer; and performing a grouting and a waiting on cement process on the auxiliary grouting layer.

5. The method of segmented directional grouting for repairing aquifers in a mining area according to claim 4, wherein, a vertical distance between the auxiliary grouting layer and the target grouting layer is from 10 m to 15 m.

6. The method of segmented directional grouting for repairing aquifers in a mining area according to claim 4, wherein, performing the grouting and the waiting on cement process on the auxiliary grouting layer comprises:

grouting slurry with a fifth specific gravity into the auxiliary grouting layer according to the second pump volume; wherein, the fifth specific gravity is greater than the first specific gravity and less than the second specific gravity; and in response to determining the grouting pressure has maintained stable for the first preset time, stopping grouting and waiting on cement.

7. The method of segmented directional grouting for repairing aquifers in a mining area according to claim 4, wherein, performing the segmented grouting in the target grouting layer through the grouting hole comprises:

drilling the grouting hole further to the target grouting layer after the waiting on cement process; and drilling multiple branch holes horizontally in the target grouting layer, and performing the segmented grouting in the multiple branch holes.

* * * * *